US010362910B2

(12) United States Patent
Chou

(10) Patent No.: US 10,362,910 B2
(45) Date of Patent: Jul. 30, 2019

(54) HAND DRYER DEVICE

(71) Applicant: CHICONY POWER TECHNOLOGY CO., LTD., New Taipei (TW)

(72) Inventor: Chen-Shi Chou, New Taipei (TW)

(73) Assignee: CHICONY POWER TECHNOLOGY CO., LTD., New Taipei (TW)

( * ) Notice: Subject to any disclaimer, the term of this patent is extended or adjusted under 35 U.S.C. 154(b) by 111 days.

(21) Appl. No.: 15/724,794

(22) Filed: Oct. 4, 2017

(65) Prior Publication Data

US 2019/0045983 A1 Feb. 14, 2019

(30) Foreign Application Priority Data

Aug. 14, 2017 (TW) ..... 106127456 A

(51) Int. Cl.

| | |
|---|---|
| ***A47K 10/48*** | (2006.01) |
| ***F26B 25/16*** | (2006.01) |
| ***F26B 21/12*** | (2006.01) |
| ***F26B 21/00*** | (2006.01) |

(52) U.S. Cl.

CPC ..... *A47K 10/48* (2013.01); *F26B 21/001* (2013.01); *F26B 21/004* (2013.01); *F26B 21/12* (2013.01); *F26B 25/16* (2013.01)

(58) Field of Classification Search

CPC ..... A47K 10/48; F26B 21/001; F26B 21/004; F26B 21/12; F26B 25/16

USPC ..... 34/202

See application file for complete search history.

(56) References Cited

U.S. PATENT DOCUMENTS

| | | | | |
|---|---|---|---|---|
| 4,993,172 A * | 2/1991 | Allen | A45D 20/16 34/202 |
| 5,459,944 A * | 10/1995 | Tatsutani | A47K 10/48 34/202 |
| 5,546,678 A * | 8/1996 | Dhaemers | D06F 58/10 34/224 |
| 5,979,014 A | 11/1999 | Reichow et al. | |
| 6,038,786 A * | 3/2000 | Aisenberg | A47K 10/48 34/202 |

(Continued)

FOREIGN PATENT DOCUMENTS

| | | |
|---|---|---|
| CN | 103948346 A | 7/2014 |
| CN | 103284648 B | 1/2016 |

(Continued)

*Primary Examiner* — Stephen M Gravini
(74) *Attorney, Agent, or Firm* — Geissler, Olds, Lowe & Olds, P.C.

(57) ABSTRACT

A hand dryer device cooperated with an airflow driver includes a first housing, a second housing, and an airflow driving unit. The first housing has a first body and a first extension portion. The second housing has a second body and a second extension portion. The second body is connected to the first body for defining an accommodating space, and the first and second extension portions together form a concave annular structure having an extension space. The airflow driving unit includes a sensor, a control module and an airflow guiding structure. The sensor is disposed on the outer surface of the first housing and/or the second housing. The sensor detects and outputs a sensing signal. The control module receives the sensing signal and outputs a control signal. The airflow guiding structure is disposed adjacent to an air outlet and extends to the extension space.

17 Claims, 6 Drawing Sheets

(56) References Cited

U.S. PATENT DOCUMENTS

| | | | | |
|---|---|---|---|---|
| 6,050,000 | A * | 4/2000 | Curzon | A47K 10/48 34/202 |
| 7,437,833 | B2 * | 10/2008 | Sato | A47K 10/48 34/90 |
| 7,596,883 | B2 * | 10/2009 | Kameishi | A47K 10/48 250/432 R |
| 7,614,160 | B2 * | 11/2009 | Kameishi | A47K 10/48 34/90 |
| 7,971,368 | B2 * | 7/2011 | Fukaya | A47K 10/48 222/1 |
| 8,341,853 | B2 * | 1/2013 | French | A47K 10/48 15/300.1 |
| 8,347,521 | B2 * | 1/2013 | Churchill | A47K 10/48 134/26 |
| 8,414,670 | B2 | 4/2013 | Lee | |
| 8,490,291 | B2 * | 7/2013 | Churchill | A47K 10/48 222/1 |
| 8,850,713 | B2 * | 10/2014 | Nakamura | A47K 10/48 132/73 |
| 9,060,657 | B2 * | 6/2015 | Ryan | A47K 10/48 |
| 9,125,533 | B2 * | 9/2015 | Babikian | A47K 10/485 |
| 9,421,291 | B2 * | 8/2016 | Robert | A61L 2/14 |
| 9,538,886 | B2 * | 1/2017 | Ros Marin | A47K 10/48 |
| 9,826,865 | B2 * | 11/2017 | Maruyama | G01F 23/268 |
| 10,165,908 | B1 * | 1/2019 | Liu | A47K 10/48 |
| 2007/0079524 | A1 * | 4/2007 | Sato | A47K 10/48 34/202 |
| 2011/0192286 | A1 | 8/2011 | Lee | |
| 2016/0007813 | A1 * | 1/2016 | Ros Mar N | A47K 10/48 34/569 |
| 2019/0045983 | A1 * | 2/2019 | Chou | A47K 10/48 |

FOREIGN PATENT DOCUMENTS

| | | | | |
|---|---|---|---|---|
| CN | 204931549 | U | 1/2016 | |
| CN | 106264319 | A | 1/2017 | |
| EP | 3058859 | A1 * | 8/2016 | A47K 10/48 |
| EP | 2957205 | A4 * | 11/2016 | A47K 10/48 |
| EP | 3058859 | B1 * | 9/2018 | A47K 10/48 |
| TW | 210011 | | 7/1993 | |
| TW | M379412 | U | 5/2010 | |
| TW | I551253 | B | 10/2016 | |
| TW | 201701814 | A | 1/2017 | |
| WO | WO-2014125146 | A1 * | 8/2014 | A47K 10/48 |
| WO | WO-2014160583 | A3 * | 12/2014 | A61L 2/14 |
| WO | WO 2010/072150 | A1 | 1/2017 | |

* cited by examiner

HAND DRYER DEVICE

CROSS REFERENCE TO RELATED APPLICATIONS

This Non-provisional application claims priority under 35 U.S.C. § 119(a) on Patent Application No(s). 106127456 filed in Taiwan, Republic of China on Aug. 14, 2017, the entire contents of which are hereby incorporated by reference.

BACKGROUND

Technology Field

The present disclosure relates to a hand driving device that can cooperate with an airflow driver.

Description of Related Art

The current home appliances are developed to achieve more efficiency and have more additional functions. Some home appliances, which can generate strong airflows (e.g. wireless vacuum cleaners, hair dryers and the likes), are used for temporary and are mostly rested. However, these devices occupy a certain space for storage, and the internal components thereof may easily damage to reduce the lifetime of the devices if the devices are not frequently used.

Since the hand dryer is expensive and is not easily installed, it is not popularized in every family. In general, after the user washes hands, the water remained on the hands of the user may drop and wet the floor. If no proper anti-slip equipment is provided, it is possible to cause some accidents. Of course, the user can use tissue papers to wipe the remained water, but this is not an environment friendly solution.

Therefore, it is desired to provide the home appliances with the hand dryer function thereby improving the convenient life, and solving the issue of accommodation space in house.

In view of the above, it is an important subject to provide a hand dryer device that can cooperate with the airflow driver of other home appliances, thereby improving the convenient life.

SUMMARY

To achieve the above, this disclosure provides a hand dryer device used to cooperate with an airflow driver. The hand dryer device includes a first housing, a second housing, and an airflow driving unit. The first housing has a first body and a first extension portion, and the first extension portion is connected to the first body. The second housing is disposed corresponding to the first housing and has a second body and a second extension portion. The second extension portion is connected to the second body, and the second body is connected to the first body for defining an accommodating space. The second extension portion and the first extension portion together form a concave annular structure, and the concave annular structure has an extension space therein. The airflow driving unit is disposed in the accommodating space and the extension space, and includes a sensor, a control module and an airflow guiding structure. The sensor is disposed on an outer surface of the first housing and/or the second housing. The sensor detects and outputs a sensing signal. The control module receives the sensing signal and outputs a control signal. The airflow guiding structure is disposed adjacent to an air outlet and extends to the extension space.

In one embodiment, the airflow guiding structure includes a bag. A shape of the bag is gradually narrowed in radius toward the extension space. One end of the bag covers the air outlet, and another end of the bag is disposed outside the extension space.

In one embodiment, the airflow guiding structure further includes an isolation plate disposed inside the accommodating space, an edge of the isolation plate is connected to inner surfaces of the first housing and the second housing, and the isolation plate has an opening.

In one embodiment, the airflow guiding structure further includes at least a guiding plate, the guiding plate is connected to a periphery of the opening of the isolation plate, and the guiding plate extends from the periphery of the opening to the extension space.

In one embodiment, the first extension portion and/or the second extension portion includes at least a nozzle, the nozzle is disposed at one end of the first extension portion and/or the second extension portion, and the nozzle is a hollow gradual-narrowed opening.

In one embodiment, the airflow driving unit further includes a sealing structure disposed at a junction of the airflow guiding structure and the air outlet for forming a closed air channel.

In one embodiment, the hand dryer device further includes a drainage unit disposed on the first body or the second body, and the drainage unit is isolated with the accommodating space and the extension space.

In one embodiment, the sensor is a photosensitive circuit, and when the photosensitive circuit receives an optical signal, the photosensitive circuit outputs the sensing signal to the control module.

In one embodiment, the sensor is an infrared beam interruption circuit, and when the infrared beam interruption circuit receives an interruption signal, the infrared beam interruption circuit outputs the sensing signal to the control module.

In one embodiment, the sensor is a wireless remote-control receiving unit, and when the wireless remote-control receiving unit receives a remote-control signal, the wireless remote-control receiving unit outputs the sensing signal to the control module.

In one embodiment, the control signal is an enabling signal or a disabling signal.

In one embodiment, the airflow driving unit further includes a charging mechanism disposed inside the accommodating space for charging the airflow driver.

In one embodiment, the hand dryer device further includes a moving mechanism disposed on the outer surface of the first housing and/or the second housing.

In one embodiment, the first extension portion and/or the second extension portion further includes an installation structure disposed on the first housing and/or the second housing, and the hand dryer device is installed on a periphery structure via the installation structure.

As mentioned above, the home appliance can be disposed in the first housing and the second housing of the hand dryer device of this disclosure. Then, the sensor and the control module of the airflow driving unit can sense and enable the airflow driver of the home appliance for generating a strong airflow. The airflow guiding structure disposed adjacent to the air outlet of the airflow driver can guide the strong airflow out of the hand dryer device for providing a hand dryer function. This configuration can also solve the accommodation space in house and improve the convenient life.

BRIEF DESCRIPTION OF THE DRAWINGS

The disclosure will become more fully understood from the detailed description and accompanying drawings, which are given for illustration only, and thus are not limitative of the present disclosure, and wherein.

DETAILED DESCRIPTION OF THE DISCLOSURE

The present disclosure will be apparent from the following detailed description, which proceeds with reference to the accompanying drawings, wherein the same references relate to the same elements.

Figure 1A:
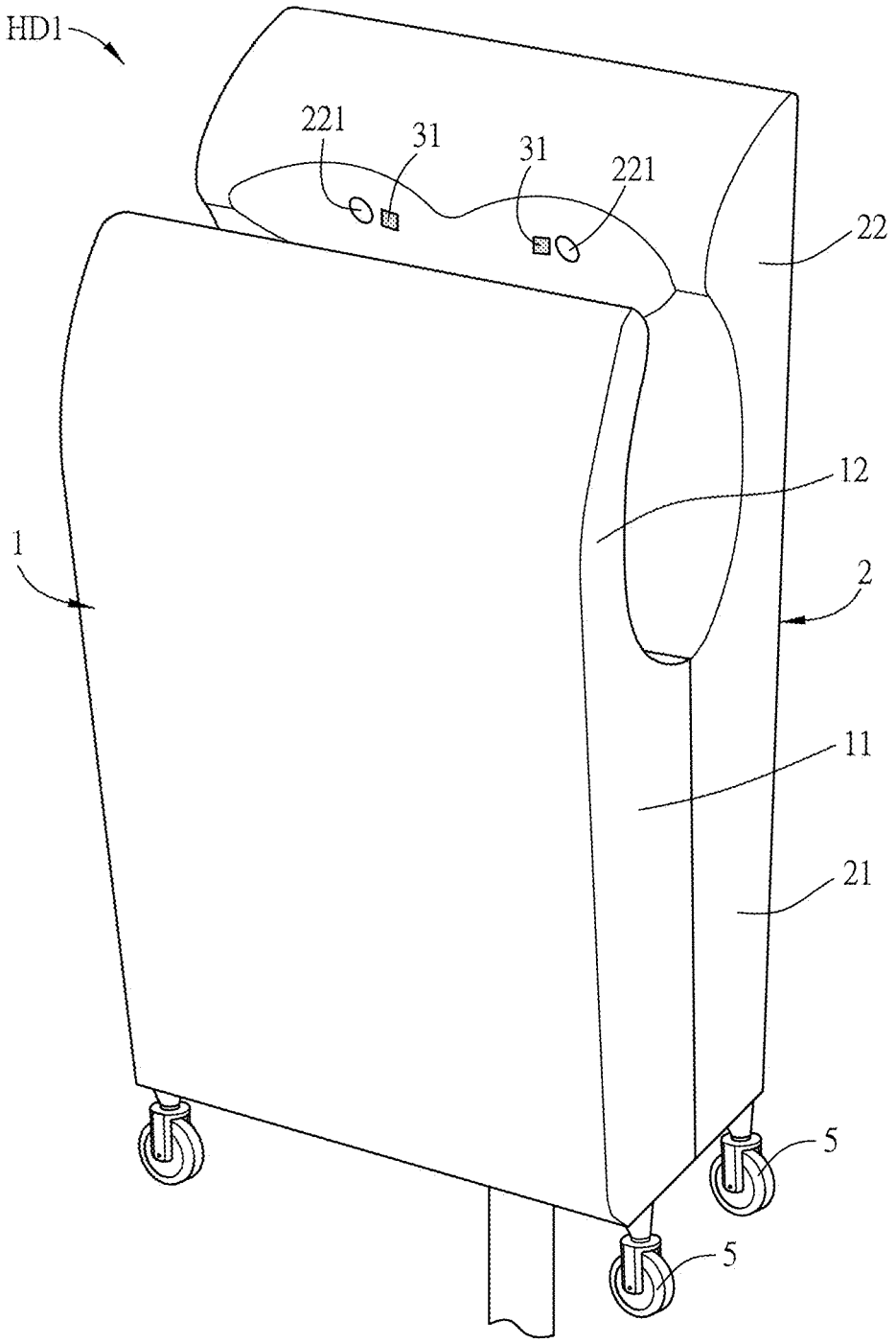
FIG. 1A is a schematic diagram showing a hand dryer device according to an embodiment of the disclosure.
Figure 1B:
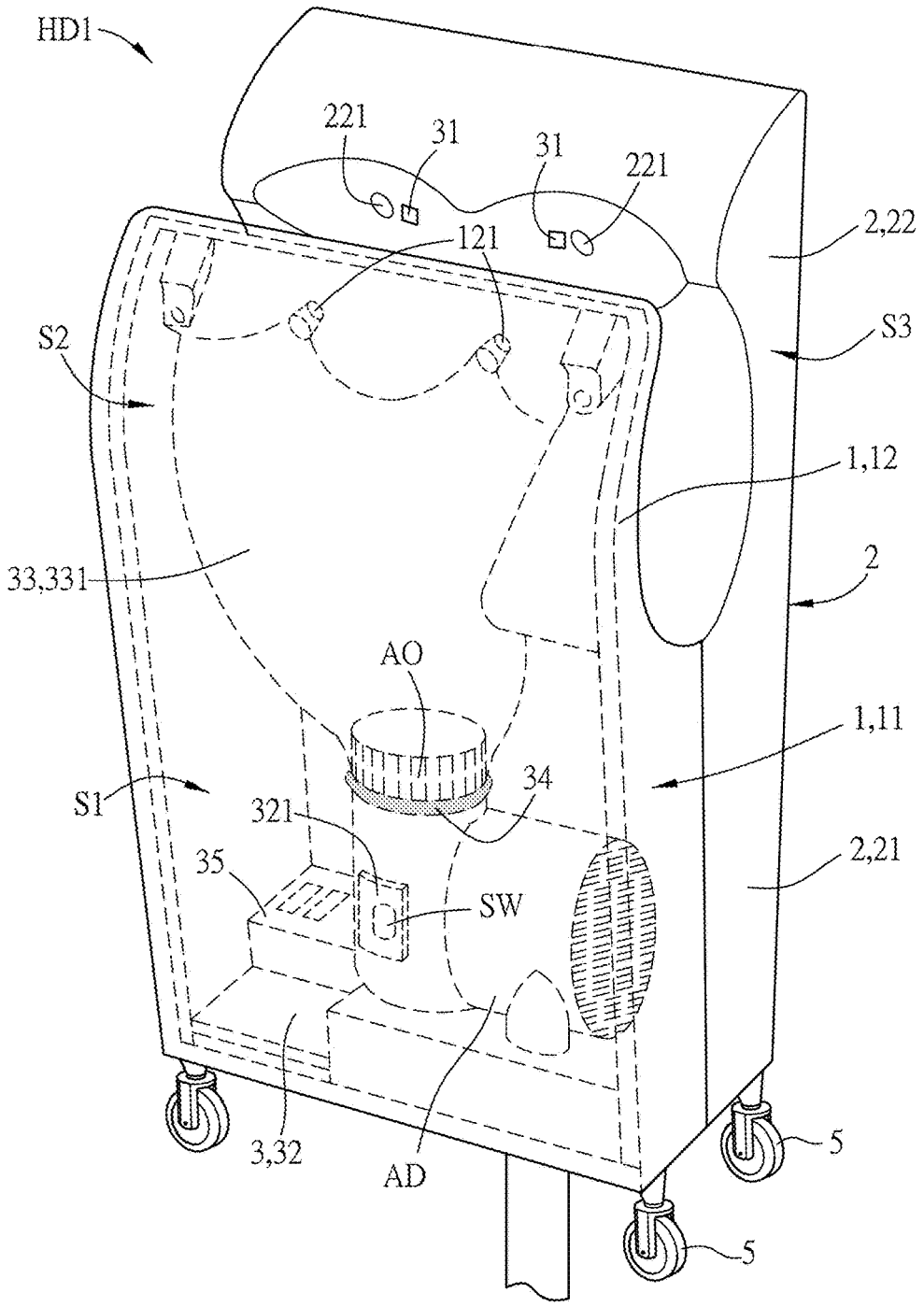
FIG. 1B is a perspective view of the hand dryer device of FIG. 1A.
Figure 1C:
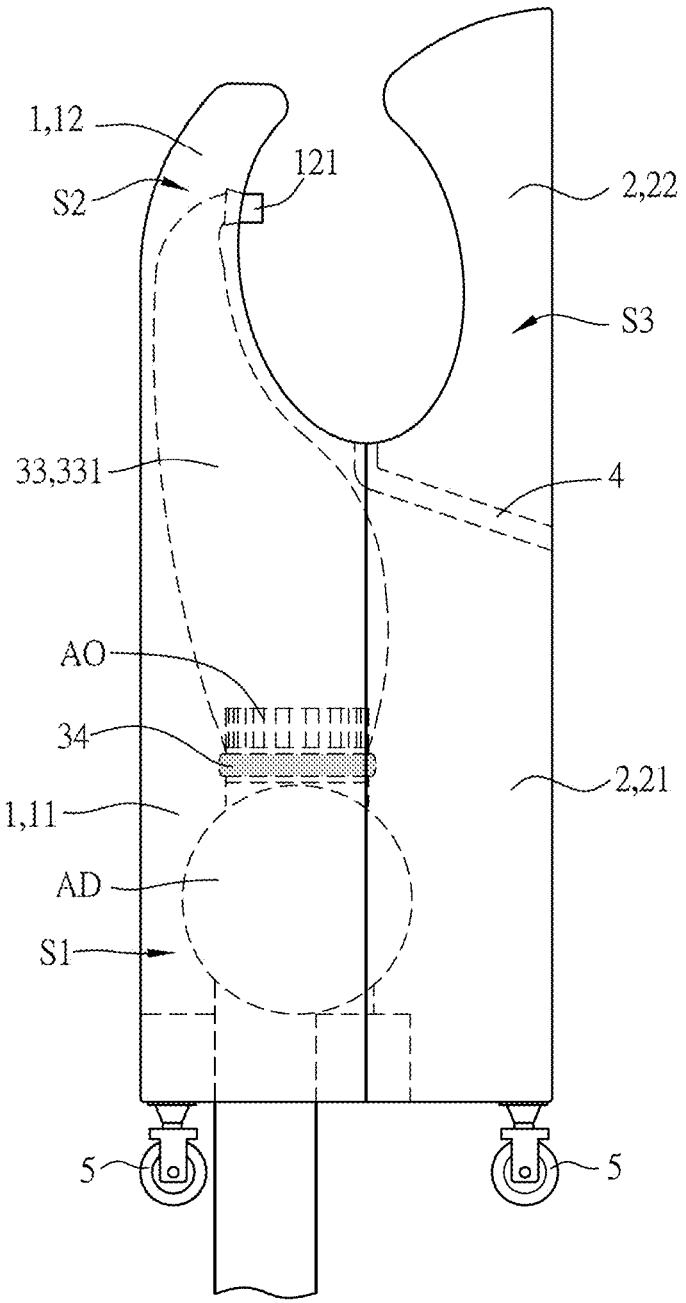
FIG. 1C is a perspective side view of the hand dryer device of FIG. 1A.

The basic structure and the features of a hand dryer device according to an embodiment of the disclosure will be described hereinafter with reference to FIGS. 1A to 1C. FIG. 1A is a schematic diagram showing a hand dryer device according to an embodiment of the disclosure, FIG. 1B is a perspective view of the hand dryer device of FIG. 1A, and FIG. 1C is a perspective side view of the hand dryer device of FIG. 1A. In order to make the figures more clear and comprehensive, FIGS. 1B and 1C only show an airflow guiding structure disposed at one side of the first and second housings. In practice, it is possible to configure two airflow guiding structures at two sides of the first and second housings depending on the requirement and design.

This disclosure provides a hand dryer device HD1 used to cooperate with an airflow driver AD. The airflow driver AD can be a home appliance that can generate a strong airflow, such as the wireless vacuum cleaner or hair dryer. The airflow generated by the airflow driver AD can cooperate with the hand dryer device HD1 so as to achieve the dual function of hand drying and vacuum cleaning. In this embodiment, the hand dryer device HD1 includes a first housing 1, a second housing 2, and an airflow driving unit 3. The first housing 1 has a first body 11 and a first extension portion 12, and the first extension portion 12 is connected to the first body 11. The second housing 2 is disposed corresponding to the first housing 1 and has a second body 21 and a second extension portion 22. The second extension portion 22 is connected to the second body 21, and the second body 21 is connected to the first body 11 for defining an accommodating space S1. The airflow driver AD can be received in the accommodating space S1. In this embodiment, the first housing 1 or the second housing 2 has an opening, or the first housing 1 and the second housing 2 are pivotally connected so they can be opened. Accordingly, the airflow driver AD can be disposed into the hand dryer device HD1 through the opening or by opening the pivotally connected first and the second housings 1 and 2.

As shown in FIG. 1C, the second extension portion 22 and the first extension portion 12 together form a concave annular structure. The concave annular structure can accumulate the airflow outputted from the hand dryer device HD1 for enhancing the drying effect. In this embodiment, the concave annular structure has extension spaces S2, S3 therein. The lateral widths of the extension spaces S2, S3 are gradually reduced as the extension spaces S2, S3 extend from the accommodating space S1 toward the nozzles 121, 221, respectively, for increasing the pressure of the airflow as well as the intensity of the outputted airflow. In addition, the airflow driving unit 3 is disposed in the accommodating space S1 and the extension spaces S2, S3. The airflow driving unit 3 includes a sensor 31, a control module 32 and an airflow guiding structure 33. The sensor 31 is disposed on an outer surface of the first housing 1 and/or the second housing 2. When the user inserts his/her hands into the space within the concave annular structure, the sensor 31 can detect the inserted hands and output a sensing signal. The control module 32 receives the sensing signal and outputs a control signal for enabling the airflow driver AD to output a strong airflow. The airflow guiding structure 33 is disposed adjacent to an air outlet AO of the airflow driver AD and extends to the extension spaces S2, S3. Thus, the airflow outputted from the air outlet AO can flow out of the hand dryer device HD1 via the airflow guiding structure 33 for providing the hand drying function. Furthermore, the airflow driving unit 3 further includes a charging mechanism 35 disposed inside the accommodating space S1 for charging the airflow driver AD by wire or wireless. In order to improve the mobility and convenience of the hand dryer device HD1, it may further include a moving mechanism 5 disposed on the outer surface of the first housing 1 and/or the second housing 2. In this embodiment, the moving mechanism 5 is wheels disposed at the bottom of the first housing 1 and/or the second housing 2.

As shown in FIGS. 1B and 1C, the airflow guiding structure 33 of this embodiment includes a bag 331. A shape of the bag 331 is gradually narrowed in radius toward the extension space S2. One end of the bag 331 covers the air outlet AO of the airflow driver AD, and another end of the bag 331 is disposed outside the extension space S2. The function of the bag 331 is to increase the pressure of the airflow. Besides, the bag 331 can guide the airflow outputted from the air outlet AO to flow out of the hand dryer device HD1. In this embodiment, the bag 331 can be made of rubber, elastic material or other plastics materials, so that it can fit the size of the air outlet AO of the airflow driver AD and the shape of the internal space of the hand dryer device HD1. The lateral width of the extension space S2 of the first housing 1 and the second housing 2 is gradually narrowed for increasing the pressure of the airflow as well as the intensity of the outputted airflow. Moreover, this design can also support the bag 331 and provide the stability for the airflow field.

In addition, the first extension portion 12 includes at least a nozzle 121, and/or the second extension portion 22 includes at least a nozzle 221. As shown in FIG. 1B, the first extension portion 12 includes two nozzles 121, and the second extension portion 22 includes two nozzles 221. The nozzles 121 are disposed at one end of the first extension portion 12, and the nozzles 221 are disposed at one end of the second extension portion 22. Each of the nozzles 121 and 221 is a hollow gradual-narrowed opening. This configuration can further press the airflow outputted from the hand dryer device HD1 to further enhance the intensity of the output airflow from the hand dryer device HD1.

In order to further improve the airflow guiding effect of the bag 331, the airflow driving unit 3 can further include a sealing structure 34 disposed at a junction of the airflow guiding structure 33 and the air outlet AO of the airflow driver AD for forming a closed air channel. In more detailed, the sealing structure 34 is an O-ring or a spiral locking structure made of rubber or extendable elastic material. Thus, the sealing structure 34 can mount on and fit to different shapes of airflow driver AD. When the air outlet AO of the airflow driver AD is completely covered by the bag 331, the junction of the bag 331 and the air outlet AO can be mounted and sealed by the sealing structure 34 for eliminating the gap between the bag 331 and the air outlet AO. This configuration can achieve a substantial airtight status, and the airflow guiding structure 33 can provide a closed air channel.

Figure 2A:
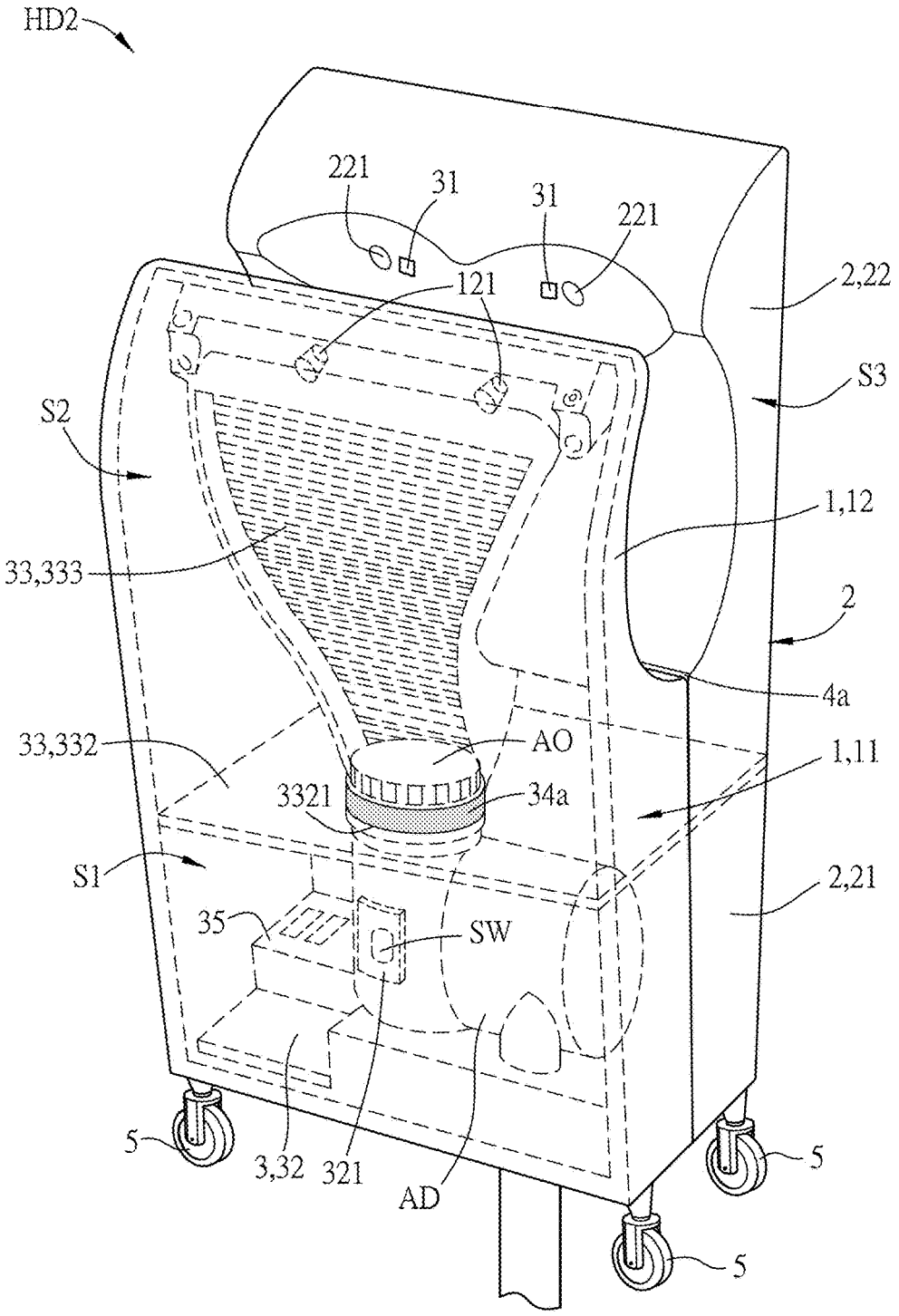
FIG. 2A is a perspective view of a hand dryer device according to another embodiment of the disclosure.
Figure 2B:
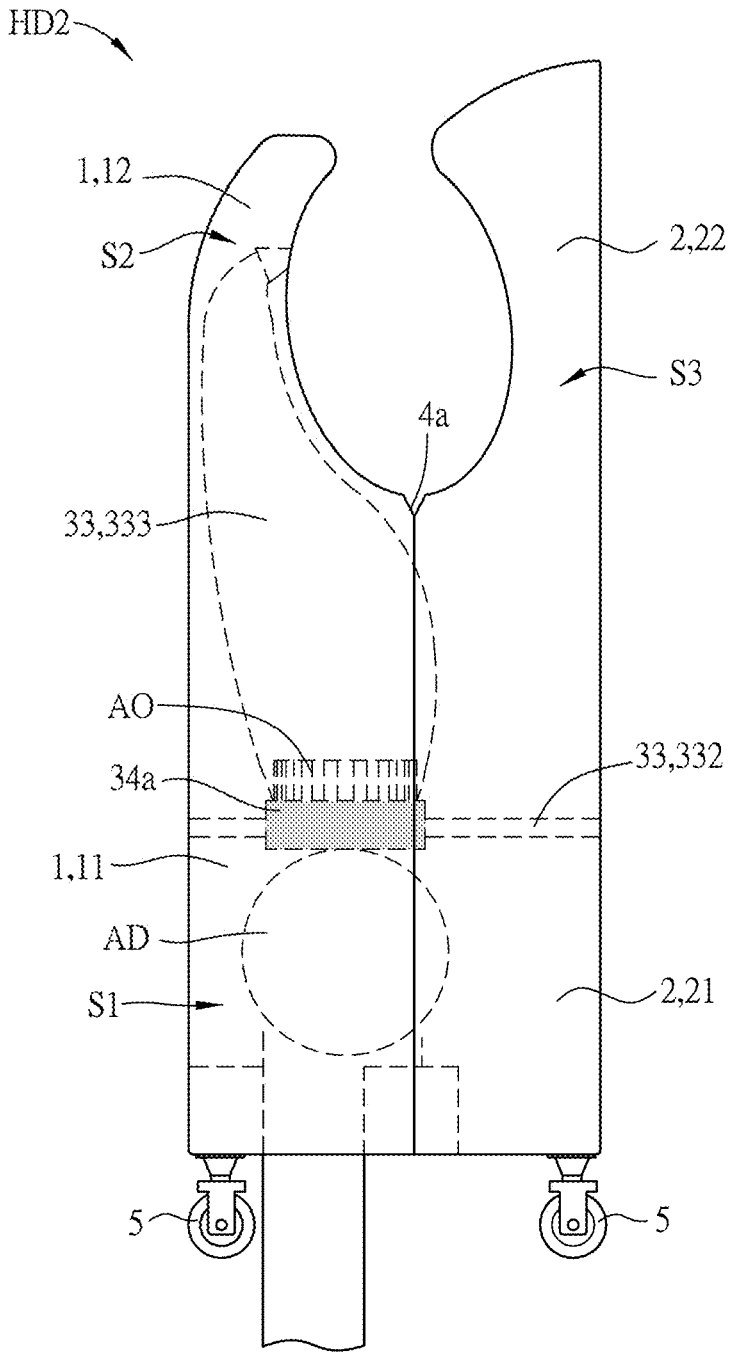
FIG. 2B is a perspective side view of the hand dryer device of FIG. 2A.

Another embodiment of the airflow guiding structure 33 will be described hereinafter with reference to FIGS. 2A and 2B. FIG. 2A is a perspective view of a hand dryer device according to another embodiment of the disclosure, and FIG. 2B is a perspective side view of the hand dryer device of FIG. 2A. In order to make the figures more clear and comprehensive, FIGS. 2A and 2B only show an airflow guiding structure disposed at one side of the first and second housings. In practice, it is possible to configure two airflow guiding structures at two sides of the first and second housings depending on the requirement and design.

In this embodiment, the airflow guiding structure 33 further includes an isolation plate 332 disposed inside the accommodating space S1. An edge of the isolation plate 332 is connected to the inner surfaces of the first housing 1 and the second housing 2, and the isolation plate 332 has an opening 3321. The airflow driver AD is disposed through the opening 3321 of the isolation plate 332. In addition, the airflow guiding structure 33 further includes at least a guiding plate 333. The guiding plates 333 are connected to a periphery of the opening 3321 of the isolation plate 332, and the guiding plates 333 extend from the periphery of the opening 3321 to the extension space S2. Herein, the guiding plates 333 can together form an airtight channel. As shown in FIG. 2B, the lateral width of the extension spaces S2, S3 are gradually narrowed, and the guiding plates 333 disposed in the extension space S2 also fit to the shape of the extension space S2 to form a channel with gradually narrowed lateral width. This configuration can increase the pressure of the airflow as well as the intensity of the outputted airflow. This embodiment only shows one airflow guiding structure 33 disposed at one side. In practice, it is possible to configure two airflow guiding structures 33 at two sides of the first housing 1 and the second housing 2 depending on the requirement and design of the hand dryer device HD2. In addition, the first extension portion 12 includes at least a nozzle 121, and/or the second extension portion 22 includes at least a nozzle 221. As shown in FIG. 2A, the first extension portion 12 includes two nozzles 121, and the second extension portion 22 includes two nozzles 221. The nozzles 121 are disposed at one end of the first extension portion 12, and the nozzles 221 are disposed at one end of the second extension portion 22. Each of the nozzles 121 and 221 is a hollow gradual-narrowed opening. This configuration can further press the airflow outputted from the hand dryer device HD2 to further enhance the intensity of the output airflow from the hand dryer device HD2.

In more detailed, the isolation plate 332 can divide the space inside the first housing 1 and the second housing 2 into an upper space and a lower space. The opening 3321 of the isolation plate 332 is disposed at the edge of the airflow driver AD, so that the airflow driver AD can pass through it. Thus, the air outlet AO of the airflow driver AD is disposed in the upper space of the opening 3321 of the isolation plate 332. Since the guiding plates 333 are connected to the periphery of the opening 3321 of the isolation plate 332, the strong airflow outputted form the air outlet AO of the airflow driver AD can be assigned with two pressing steps by the airtight channel of the guiding plates 333 and the nozzles 121, 221 and then outputted from the hand dryer device HD2.

In order to further improve the airflow guiding effect of the bag 331, the airflow driving unit 3 can further include a sealing structure 34*a* disposed at a junction of the airflow guiding structure 33 and the air outlet AO of the airflow driver AD for forming a closed air channel. In other words, the sealing structure 34*a* is disposed between the opening 3321 of the isolation plate 332 and the airflow driver AD, and is located adjacent to the air outlet AO. In more detailed, the sealing structure 34*a* is an O-ring or a locking structure made of rubber or extendable elastic material. Thus, the sealing structure 34*a* can mount on and fit to different shapes of the airflow driver AD and the opening 3321 of the isolation plate 332. When the gap between the opening 3321 of the isolation plate 332 and the airflow driver AD is completely sealed by the sealing structure 34*a*, a substantial airtight status can be achieved, and the airflow guiding structure 33 can provide a complete closed air channel.

The other related structures and configurations of the hand dryer device HD2 are the same as those of the hand dryer device HD1 of FIGS. 1B and 1C, so the detailed descriptions thereof will be omitted.

The other detailed structures of the hand dryer devices HD1 and HD2 will be described hereinbelow. As shown in FIGS. 1C and 2B, the hand dryer devices HD1 and HD2 further includes drainage units 4 and 4*a*, respectively. The drainage units 4 and 4*a* can be disposed on the first body 11 or the second body 21, and the drainage units 4 and 4*a* are isolated with the accommodating space S1 and the extension spaces S2 and S3. The configuration of the drainage units 4 and 4*a* does not affect the closed air channel of the airflow guiding structure 33. Furthermore, the drainage units 4 and 4*a* include at least one water discharging hole (see FIG. 1C) or a water discharging tank (see FIG. 2B), which is disposed on the first body 11 or the second body 21 and located on the outer surface of the concave annular structure of the first extension portion 12 and the second extension portion 22. The drainage units 4 and 4*a* can collect the water dropped from the hands and then discharge the collected water from the housings of the hand dryer devices HD1 and HD2. As shown in FIG. 1C, the drainage unit 4 further includes pipes connecting to the water discharging holes for guiding the collected water out of the hand dryer device HD1.

Figure 3:
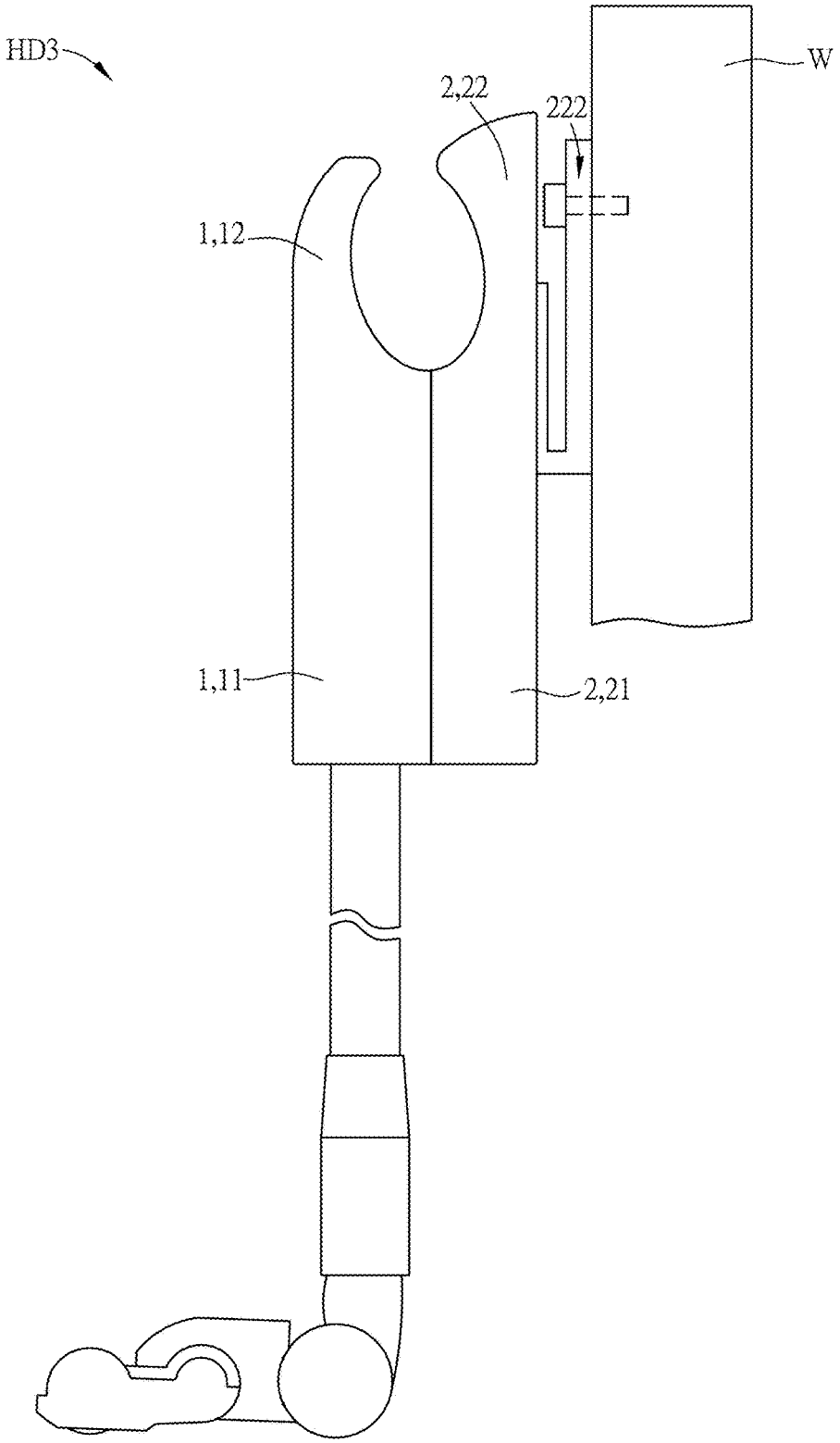
FIG. 3 is a perspective side view of a hand dryer device equipped with an installation structure of this disclosure.

In this disclosure, the first extension portion 12 and/or the second extension portion 22 further includes at least one installation structure disposed on the first housing 1 and/or the second housing 2. As shown in FIG. 3, the second extension portion 22 further includes an installation structure 222 disposed on the second housing 2. The hand dryer device HD3 is installed on a periphery structure via the installation structure 222. In more specific, the installation structure 222 can be a common hanging structure such as, for example but not limited to, a metal hook or support frame. The installation structure 222 as well as the hand dryer device HD3 can be fixed on the wall W by screwing, nailing, locking, or adhering. In this embodiment, the installation structure 222 can be connected to the first housing 1 and/or the second housing 2 of the hand dryer device HD3 by screwing, locking, adhering, or plastic molding injection.

The operation theory of the sensor 31, the control module 32 and the airflow driver AD of the airflow driving unit 3 will be described hereinafter with reference to the hand dryer device HD1 of FIG. 1B.

The sensor 31 of the airflow driving unit 3 is disposed on the outer surface of the first housing 1 and/or the second housing 2, and the control module 32 is disposed in the accommodating space S1. The control module 32 further includes a switch control structure 321 disposed at the switch SW of the airflow driver AD for connecting to the switch SW of the airflow driver AD and controlling the status and operation of the switch SW. When the user puts his/her hands into the space within the concave annular structure or removes his/her hands from the space, the sensor 31 performs a detection and outputs a sensing signal. Then, the control module 32 receives the sensing signal and outputs a control signal to the switch control structure 321. The metal plate (not shown) disposed inside the switch control structure 321 is operated by conducted magnetic to press the switch SW of the airflow driver AD, thereby changing the operation status of the airflow driver AD.

In this embodiment, the sensor 31 can be a photosensitive circuit, an infrared beam interruption circuit, or a wireless remote-control receiving unit depending on the design requirement of the hand dryer device HD1.

When the sensor 31 is a photosensitive circuit, the photosensitive circuit outputs a sensing signal to the control module 32 after the photosensitive circuit receives an optical signal. The control module 32 receives the sensing signal and outputs a control signal to the switch control structure 321. The control signal can be an enabling signal or a disabling signal. The switch control structure 321 can enable or disable the airflow driver AD based on the instruction of the control signal so as to change the operation status of the airflow driver AD.

In addition, if the sensor 31 is an infrared beam interruption circuit, when the user puts his/her hands into the space formed by the concave annular structure, the infrared beam interruption circuit can receive an interruption signal, and outputs a sensing signal to the control module 32. The control module 32 receives the sensing signal and outputs a control signal to the switch control structure 321. The switch control structure 321 is operated based on the instruction of the control signal so as to enable the airflow driver AD.

In addition, if the sensor 31 is a wireless remote-control receiving unit, when the wireless remote-control receiving unit receives a remote-control signal, the wireless remote-control receiving unit outputs a sensing signal to the control module 32. The control module 32 receives the sensing signal and outputs a control signal to the switch control structure 321. The switch control structure 321 is operated based on the instruction of the control signal so as to enable or disable the airflow driver AD.

In this embodiment, the control module 32 can output various control signals based on the operation setup of the airflow driver AD. The control signal can be an enabling signal or a disabling signal. Furthermore, when the control signal is an enabling signal, the metal plate (not shown) of the switch control structure 321 can be controlled to press the switch SW of the airflow driver AD for once, to push the switch SW of the airflow driver AD in one direction, or to continuously press the switch SW of the airflow driver AD, thereby enabling the airflow driver AD to generate airflow. Similarly, when the control signal is a disabling signal, the metal plate of the switch control structure 321 can be controlled to press the switch SW of the airflow driver AD for once, to push the switch SW of the airflow driver AD in another direction, or to release the switch SW of the airflow driver AD, thereby disabling the airflow driver AD.

Besides, the metal plate can cooperate with a sliding block and a sliding slot structure (not shown) for controlling the operation of the airflow driver AD. In practice, the sliding block clips the switch SW of the airflow driver AD, and the metal plates inside the switch control structure 321 are disposed at two sides of the sliding block, respectively. When the control signal is an enabling signal, one of the metal plates can push the switch SW of the airflow driver AD in one direction, so that the sliding block and the switch SW are moved together along the direction so as to enable the airflow driver AD. When the control signal is a disabling signal, the other metal plate can push the switch SW of the airflow driver AD in another direction, so that the sliding block and the switch SW are moved together along the opposite direction so as to disable the airflow driver AD.

In this embodiment, the sensor 31 can detect the position of the hands, and the control module 32 can control the switch control structure 321 to operate the switch SW of the airflow driver AD. This configuration can control and switch the operation status of the airflow driver AD. Besides, the control module 32 and the sensor 31 can output different control signals to airflow driver AD for executing different instructions and operations. Thus, the hand driver device HD1 can be applied to various airflow drivers AD.

As mentioned above, the hand dryer device of this disclosure has a design on the first housing, the second housing and the airflow guiding structure for accommodating and receiving different airflow drivers. The bag, isolation plate, and guiding plate of the airflow guiding structure can be cooperated with various airflow drivers, so that the strong airflow outputted form the air outlet of the airflow driver can be outputted from the hand dryer device. Besides, the design of the sealing structure can substantially enclose the gap between the airflow guiding structure and the airflow driver, thereby enhancing the stability of the flow field. Moreover, the configuration of the first extension portion, the second extension portion, the airflow guiding structure and the nozzle with a lateral gradual-narrowed design can increase the airflow pressure and air output intensity, and effectively concentrate the outputted airflow from the hand dryer device so as to enhance the drying effect.

Moreover, the sensor and control module can control the switch control structure to execute a control operation on the switch of the airflow driver based on different instructions. This configuration can control the operation status of the airflow driver, and allow the hand dryer device to be applied to different kinds of the airflow drivers.

Furthermore, the hand dryer device of this disclosure can assign an additional hand dryer function to the home appliances. This is different from the conventional commercial hand dryers, so that the cost for installing an additional hand dryer is not needed. If the hand dryer device of this disclosure is cooperated with a vacuum cleaner, it is possible to further dry the wet floor. In practice, when the hand dryer device is configured in the toilet or kitchen, the sensor can be operated to keep the floor dry all the time. This configuration can also solve the accommodation space in house and improve the convenient life.

Although the disclosure has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the disclosure.

What is claimed is:

1. A hand dryer device used to cooperate with a home appliance having an airflow driver, comprising:

a first housing having a first body and a first extension portion, wherein the first extension portion is connected to the first body;

a second housing disposed corresponding to the first housing and having a second body and a second extension portion, wherein the second extension portion is connected to the second body, the second body is connected to the first body for defining an accommodating space, the second extension portion and the first extension portion together form a concave annular structure, the concave annular structure has an extension space therein, and the home appliance is received in the accommodating space; and an airflow driving unit disposed in the accommodating space and the extension space, and comprises:

a sensor disposed on an outer surface of the first housing and/or the second housing, wherein the sensor detects and outputs a sensing signal, a control module receiving the sensing signal and outputting a control signal to enable the airflow driver of the home appliance to output a strong airflow, and an airflow guiding structure disposed adjacent to an air outlet of the airflow driver and extending to the extension space.

2. The hand dryer device of claim 1, wherein the airflow guiding structure comprises a bag, one end of the bag covers the air outlet, a shape of the bag is gradually narrowed in radius toward the extension space, and another end of the bag is disposed outside the extension space.

3. The hand dryer device of claim 2, wherein the first extension portion and/or the second extension portion comprises at least a nozzle, the nozzle is disposed at one end of the first extension portion and/or the second extension portion, and the nozzle is a hollow gradual-narrowed opening.

4. The hand dryer device of claim 2, wherein the airflow driving unit further comprises a sealing structure disposed at a junction of the airflow guiding structure and the air outlet for forming a closed air channel.

5. The hand dryer device of claim 1, wherein the airflow guiding structure further comprises an isolation plate disposed inside the accommodating space, an edge of the isolation plate is connected to inner surfaces of the first housing and the second housing, and the isolation plate has an opening.

6. The hand dryer device of claim 5, wherein the airflow guiding structure further comprises at least a guiding plate, the guiding plate is connected to a periphery of the opening of the isolation plate, and the guiding plate extends from the periphery of the opening to the extension space.

7. The hand dryer device of claim 5, wherein the first extension portion and/or the second extension portion comprises at least a nozzle, the nozzle is disposed at one end of the first extension portion and/or the second extension portion, and the nozzle is a hollow gradual-narrowed opening.

8. The hand dryer device of claim 5, wherein the airflow driving unit further comprises a sealing structure disposed at a junction of the airflow guiding structure and the air outlet for forming a closed air channel.

9. The hand dryer device of claim 1, further comprising a drainage unit disposed on the first body or the second body, wherein the drainage unit is isolated with the accommodating space and the extension space.

10. The hand dryer device of claim 1, wherein the sensor is a photosensitive circuit, and when the photosensitive circuit receives an optical signal, the photosensitive circuit outputs the sensing signal to the control module.

11. The hand dryer device of claim 1, wherein the sensor is an infrared beam interruption circuit, and when the infrared beam interruption circuit receives an interruption signal, the infrared beam interruption circuit outputs the sensing signal to the control module.

12. The hand dryer device of claim 1, wherein the sensor is a wireless remote-control receiving unit, and when the wireless remote-control receiving unit receives a remote-control signal, the wireless remote-control receiving unit outputs the sensing signal to the control module.

13. The hand dryer device of claim 1, wherein the control signal is an enabling signal or a disabling signal.

14. The hand dryer device of claim 1, wherein the airflow driving unit further comprises a charging mechanism disposed inside the accommodating space for charging the airflow driver.

15. The hand dryer device of claim 1, further comprising a moving mechanism disposed on the outer surface of the first housing and/or the second housing.

16. The hand dryer device of claim 1, wherein the first extension portion and/or the second extension portion further comprises an installation structure disposed on the first housing and/or the second housing, and the hand dryer device is installed on a periphery structure via the installation structure.

17. The hand dryer device of claim 1, wherein the home appliance is a vacuum cleaner or a hair dryer.

* * * * *